US006739909B2

(12) United States Patent
Williams et al.

(10) Patent No.: US 6,739,909 B2
(45) Date of Patent: May 25, 2004

(54) RIGID SUPPORT RING MOLDED INTO ELASTOMERIC CONNECTOR LIP

(75) Inventors: Roger C. Williams, Santa Rosa, CA (US); Eckhard S. Konkel, Santa Rosa, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/842,386

(22) Filed: Apr. 25, 2001

(65) Prior Publication Data

US 2001/0036772 A1 Nov. 1, 2001

Related U.S. Application Data

(60) Provisional application No. 60/201,024, filed on May 1, 2000.

(51) Int. Cl.[7] ..... H01R 13/40

(52) U.S. Cl. ..... 439/592; 439/732; 439/281

(58) Field of Search ..... 439/592, 271, 439/281, 732

(56) References Cited

U.S. PATENT DOCUMENTS 3,861,721 A * 1/1975 Berghofer ..... 285/236
4,607,854 A * 8/1986 Bissi et al. ..... 277/152
5,795,173 A * 8/1998 Werner et al. ..... 439/275

* cited by examiner

*Primary Examiner*—Tho D. Ta
(74) *Attorney, Agent, or Firm*—Risto A. Rinne, Jr.

(57) ABSTRACT

An apparatus for supplying electrical power to a receptacle connector of a railroad car includes embedding a rigid support ring in an elastomeric nose portion of the receptacle connector. The support ring is disposed substantially in the elastomeric nose portion above a circumferential lip that extends along the inside circumference of the receptacle connector. The support ring preferably includes a raised portion and radius edges.

4 Claims, 1 Drawing Sheet

Side View of 10.

Side View of 10.

End View of 10.

RIGID SUPPORT RING MOLDED INTO ELASTOMERIC CONNECTOR LIP

BENEFITS OF PRIORITY

This utility patent application claims the benefit of the date of priority of "Provisional Application" No. 60/201,024 filed on May 1, 2000.

BACKGROUND OF THE INVENTION

1. Field of the Invention

The present invention, in general relates to electrical connectors and, more particularly, to devices that supply electrical power from a railroad diesel-powered locomotive to each railroad passenger car.

In passenger railroad cars, pulled by a diesel-powered locomotive, it is necessary to supply electrical power to each car. The power source is typically a generator on board the locomotive. Power is transmitted by cables, and there are power connectors on each rail car.

This technology has existed for more than 25 years, and is typically referred to as "head-end power", "hotel power" or "trainline power" in the railroad arts. Power connectors on each rail car consist of a molded elastomeric receptacle connector, secured in a metallic housing. Connecting the various receptacles are cable assemblies consisting of power cables attached to a plug connector. Environmental sealing between the two engaged connectors is achieved by an interference fit between the body of the snout of the "plug" connector and a circumferential lip extending out from the body of the "receptacle" connector, assisted by a molded-in "O-ring" construction, common in the molded connector industry.

These types of connectors are quite large and engagement forces to connect two connectors can easily exceed fifty pounds of force. Additionally, connectors are sometimes located at unusual angles and they are difficult to engage because they are hard to reach. Sometimes, when personnel make efforts to engage the connectors, the circumferential lip of the receptacle becomes inadvertently folded under making engagement difficult or impossible and, if engagement is achieved, compromising the environmental seal between the connectors. This can allow for the entrance of rain water into the connector interface, and this may, in turn, lead to electrical failure.

Manufacturers have attempted to minimize the likelihood of this problem by fastening either metallic or non-metallic support rings around the outside of the receptacle connector using an adhesive, thereby helping to prevent the connector lip from becoming turned under. This solution has been partially effective, but still leads eventually to connector problems and failures.

Accordingly there exists today a need for a solution that helps ameliorate as many of the aforementioned problems and difficulties as possible.

Clearly, such an apparatus would be a useful and desirable device.

2. Description of Prior Art

Railroad car connectors are, in general, known. While the structural arrangements of the known types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a rigid support ring molded into an elastomeric connector lip that is inexpensive to manufacture.

It is also an important object of the invention to provide a rigid support ring molded into an elastomeric connector lip that helps prevent a circumferential lip of a receptacle, also known as the "female connector", from being folded under during engagement of a plug connector, also known as the "male" connector".

Another object of the invention is to provide a rigid support ring molded into an elastomeric connector lip that helps to maintain the environmental seal between a plug connector and a receptacle connector adapted for receiving the plug therein.

Still another object of the invention is to provide a rigid support ring molded into an elastomeric connector lip that is durable.

Still yet another object of the invention is to provide a rigid support ring molded into an elastomeric connector lip that does not increase the force to insert a plug connector into a receptacle connector due to improper mating of the two connector halves.

Yet another important object of the invention is to provide a rigid support ring molded into an elastomeric connector lip that is aesthetically pleasing.

Still yet another important object of the invention is to provide a rigid support ring molded into an elastomeric connector lip that is formed integrally with a receptacle connector.

A first continuing object of the invention is to provide a rigid support ring molded into an elastomeric connector lip that can be firmly held in its proper location in a receptacle connector.

A second continuing object of the invention is to provide a rigid support ring molded into an elastomeric connector lip that includes radius edges that prevent the ring from damaging the elastomer in which it is embedded during normal use.

A third continuing object of the invention is to provide a rigid support ring molded into an elastomeric connector lip such that a molded-in O-ring on the mating plug is positioned underneath the support ring.

Briefly, a rigid support ring molded into an elastomeric connector lip that is constructed in accordance with the principles of the present invention has a metallic or a non-metallic support ring that is substantially embedded within an elastomeric portion of a lip of a receptacle connector. The rigid support ring is formed integral with the elastomeric portion of the lip and is disposed proximate (i.e., over) a lip that extends along an inner circumference of the receptacle connector.

DETAILED DESCRIPTION OF THE INVENTION

Figures 1, 2, 3, 4:
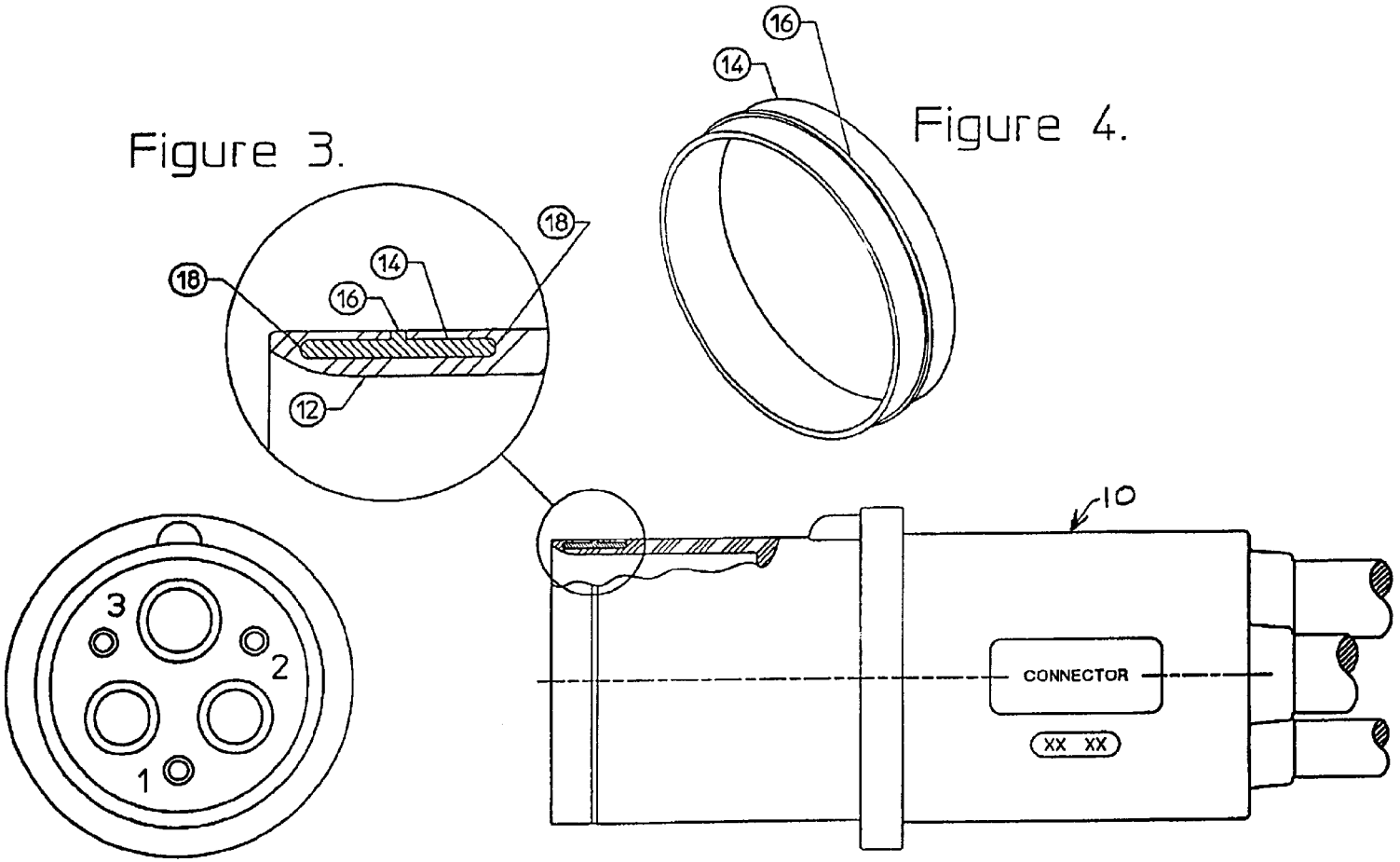
FIG. 1 is a side view of a rigid support ring molded into an elastomeric connector lip with a small portion thereof that is shown in a cross-sectional view.
FIG. 2 is an end view as shown in FIG. 1 as seen along the lines 2—2 therein.
FIG. 3 is an enlarged sectional view of the rigid support ring molded into a connector lip of FIG. 1.
FIG. 4 is a view in perspective of the rigid support ring of FIG. 1.

Referring to all of the FIGS. 1–4 drawings and in particular momentarily to FIG. 1 is shown, a receptacle connector for use in the railroad industry, identified in general by the reference numeral 10.

The receptacle connector 10 includes a connector lip 12 that is disposed within the receptacle connector 10 along an inner circumference thereof.

A rigid support ring 14 is embedded in the receptacle connector 10 over a portion of the connector lip 12.

The support ring 14 is surrounded by an elastomeric material.

The support ring 14 includes a raised portion 16 that extends about the outer circumference of the support ring 14 and it is used to retain the support ring 14 in its proper location within a mold.

A radius edge 18 is disposed on both sides of the support ring 14 and extends around the circumference thereof. Each of the radius edges 18 helps to prevent the support ring 14 from damaging the elastomeric material of the receptacle connector 10 (in which it is embedded) during use.

An end view is shown in FIG. 2 that includes a plurality of electrical connections that are disposed within the receptacle connector 10.

A plug connector (not shown) is inserted into the receptacle connector 10 and which includes an electrical mating with the plurality of electrical connections.

Accordingly, the support ring 14 prevents the lip 12 from being displaced or otherwise folded under when the plug connector is inserted therein.

The support ring 14 may be formed out of any desired material including metallic and suitable non-metallic substances.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. In an electrical system of power distribution for use with railroad passenger cars having a receptacle connector that includes an elastomeric lip, the combination with said receptacle connector of a support ring embedded in the elastomeric lip and wherein said support ring includes a raised portion that extends around at least a portion of the circumference thereof.

2. A rigid support ring molded into an elastomeric connector lip of a railroad receptacle connector, comprising:

(a) means for providing a rigid support ring adapted for insertion into said elastomeric connector; and (b) wherein said support ring includes at least one edge thereof that includes an outer radius and wherein said support ring includes a raised portion that extends around at least a portion of said outer radius along a circumference thereof.

3. A method for forming an elastomeric receptacle connector for use in supplying electrical power to a railroad car, which comprises the steps of:

(a) placing a support ring proximate a lip of said receptacle connector wherein said support ring includes a raised portion that extends around at least a portion of a circumference thereof: and (b) surrounding at least a portion of said support ring with an elastomer.

4. A rigid support ring molded into an elastomeric connector lip of a railroad receptacle connector, comprising:

(a) means for providing a rigid support ring adapted for insertion into said elastomeric connector;

(b) wherein said support ring includes at least one surface thereof that includes an outer radius and wherein said support ring includes a raised portion that extends around at least a portion of said outer radius along an outer circumference thereof; and (c) wherein when said support ring is disposed in said elastomeric connector, said support ring is surrounded by an elastomer on an inside circumference, on both of a pair of sides that are generally perpendicular with respect to said inside circumference, and wherein said support ring is surrounded by said elastomer on said outer circumference where said raised portion is absent.

* * * * *